US012173929B2

(12) United States Patent
Boros et al.

(10) Patent No.: US 12,173,929 B2
(45) Date of Patent: Dec. 24, 2024

(54) ON-DEMAND HEAT PUMP WATER HEATER

(71) Applicant: Rheem Manufacturing Company, Atlanta, GA (US)

(72) Inventors: Jozef Boros, Montgomery, AL (US); Christopher M. Hayden, Shelton, CT (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 18/380,564

(22) Filed: Oct. 16, 2023

(65) Prior Publication Data

US 2024/0044547 A1 Feb. 8, 2024

Related U.S. Application Data

(63) Continuation of application No. 16/847,771, filed on Apr. 14, 2020, now Pat. No. 11,788,769.

(51) Int. Cl.

| | |
|---|---|
| ***F24H 4/04*** | (2006.01) |
| ***F24D 19/10*** | (2006.01) |
| ***F24H 4/06*** | (2006.01) |
| ***F24H 15/174*** | (2022.01) |
| ***F24H 15/219*** | (2022.01) |
| ***F24H 15/223*** | (2022.01) |
| ***F24H 15/238*** | (2022.01) |
| ***F24H 15/281*** | (2022.01) |
| ***F24H 15/315*** | (2022.01) |

(Continued)

(52) U.S. Cl.

CPC ..... *F24H 4/04* (2013.01); *F24D 19/1015* (2013.01); *F24D 19/1054* (2013.01); *F24H 15/174* (2022.01); *F24H 15/219* (2022.01); *F24H 15/223* (2022.01); *F24H 15/238* (2022.01); *F24H 15/315* (2022.01); *F24H 15/375* (2022.01); *F24H 4/06* (2013.01); *F24H 15/281* (2022.01); *F24H 15/355* (2022.01); *F24H 15/414* (2022.01); *F24H 15/45* (2022.01)

(58) Field of Classification Search

CPC ..... F24D 19/1015; F24D 19/1054; F24H 15/174; F24H 15/219; F24H 15/223; F24H 15/238; F24H 15/281; F24H 15/315; F24H 15/355; F24H 15/375; F24H 15/414; F24H 15/45; F24H 4/06; F24H 4/04

See application file for complete search history.

(56) References Cited

U.S. PATENT DOCUMENTS 4,363,221 A * 12/1982 Singh ..... F24D 17/02 62/324.4
4,604,515 A * 8/1986 Davidson ..... F24H 15/37 219/486

(Continued)

*Primary Examiner* — Henry T Crenshaw
(74) *Attorney, Agent, or Firm* — Eversheds Sutherland (US) LLP

(57) ABSTRACT

The disclosed technology includes an on-demand water heater which uses a heat pump to heat the fluid. The on-demand heat pump water heater can have a low fluid capacity heating chamber which has an inlet and an outlet, a heat pump for heating the fluid, and a controller to control the heat pump and maintain the temperature of the fluid at a predetermined temperature. The on-demand heat pump water heater can include one or more temperature sensors, flow sensors, fluid mixing valves, or supplemental heat sources.

16 Claims, 4 Drawing Sheets

(51) Int. Cl.

| | |
|---|---|
| ***F24H 15/355*** | (2022.01) |
| ***F24H 15/375*** | (2022.01) |
| ***F24H 15/414*** | (2022.01) |
| ***F24H 15/45*** | (2022.01) |

(56) References Cited

U.S. PATENT DOCUMENTS

| | | | | |
|---|---|---|---|---|
| 5,558,273 | A | 9/1996 | Swenson et al. | |
| 6,983,723 | B2 * | 1/2006 | Brewster | F24D 1/005 122/15.1 |
| 10,088,852 | B2 * | 10/2018 | Hazzard | F24H 15/315 |
| 2001/0009609 | A1 * | 7/2001 | Bradenbaugh | F24H 15/144 392/447 |
| 2004/0194629 | A1 | 10/2004 | Jones et al. | |
| 2006/0289065 | A1 | 12/2006 | Adams | |
| 2008/0006227 | A1 | 1/2008 | Ziehm et al. | |
| 2013/0034344 | A1 * | 2/2013 | Lutz | F24H 15/486 392/449 |
| 2013/0104586 | A1 | 5/2013 | Krause et al. | |
| 2017/0219220 | A1 * | 8/2017 | Girafi | F24H 15/238 |
| 2019/0011151 | A1 | 1/2019 | Wagner et al. | |
| 2021/0270471 | A1 | 9/2021 | Hayden et al. | |

* cited by examiner

ON-DEMAND HEAT PUMP WATER HEATER

CROSS-REFERENCE TO RELATED APPLICATIONS

This is a continuation of U.S. application Ser. No. 16/847,771, filed Apr. 14, 2020, which is incorporated by reference herein.

FIELD OF TECHNOLOGY

Embodiments of the present disclosure relate generally to water heaters, and, more particularly, to on-demand water heaters which utilize a heat pump to heat the fluid.

BACKGROUND

It is common for water to be heated for many reasons, including water sanitation, cooking, and providing a more pleasing water temperature. Currently, the most common methods to heat the water utilize combustible matter or electrical heating elements as the heat source. No matter the method, it is necessary to add energy to the water to increase the water's temperature. The process of adding energy to the water to increase its temperature has inefficiencies associated with it which can be costly and time consuming. Therefore, it is desirable to heat the water as efficiently as possible.

One solution to this problem is to use a large insulated storage tank to store heated water and periodically add heat as the water temperature falls. This can provide a steady source of heated water without requiring a constant energy source. However, this solution is generally inefficient because energy is lost from the moment the water is heated, including when the water is not in use. Furthermore, this solution typically requires a large storage tank, which can often be too large to store near the location where the heated water is needed. This can cause further inefficiency because heat can dissipate as the heated water travels through pipes to the desired location for use.

A more recently developed energy source, known as a heat pump, is capable of transferring energy to water stored in a storage tank in a way that is typically more efficient than combustible matter or electrical heating elements. Rather than create the thermal energy directly, such as by combustible matter or electrical heating element energy sources, a heat pump can move thermal energy from a source of heat to a heat reservoir resulting in increased energy efficiency. In the case of heat pump water heaters, the water in the storage tank becomes the heat reservoir. Most commonly, a heat pump utilizes the vapor-compression cycle of a refrigerant to transfer thermal energy to the water in the storage tank. However, even though a heat pump is typically more energy efficient than methods using combustible matter or electrical heating elements, heat pump systems can still lose a substantial amount of energy during the process of maintaining the water in a storage tank at a desired heated temperature and then delivering that heated water to a location of use that is usually a distance away from the storage tank.

More recent water heater designs have reduced the need for a large storage tank and heat the water only when heated water is demanded. These on-demand water heaters, also known as "instantaneous" or "tankless" water heaters, supply heat only when required, which can reduce the amount of energy lost by the water heating system when the water heater is not in use. Furthermore, because on-demand water heaters do not require a large storage tank, they can be considerably smaller than traditional water heaters. The reduced size allows on-demand water heaters to be placed closer to where the heated water is needed and further reduces heat loss from water traveling through cold pipes. Because traditional energy sources, like combustible matter and electrical heating elements, are generally known to heat water quicker than a heat pump, existing on-demand water heaters typically use combustible matter or electrical heating elements. However, such heating elements can generally require a large amount of energy to operate.

Accordingly, there is a need for on-demand water heaters providing increased energy efficiency than those currently available. This and other problems are addressed by embodiments of the technology disclosed herein.

BRIEF SUMMARY

The disclosed technology can include a fluid heating device having a heat pump configured to heat a fluid (e.g., water) based on a predetermined temperature setting and predetermined flow rate.

The fluid heating device can have a low fluid capacity heating chamber having a fluid inlet, a fluid outlet, a heat pump for heating the fluid, and a controller configured to control the temperature of the fluid based on a predetermined temperature setting by controlling the heat pump.

The low fluid capacity heating chamber can include a fluid capacity of less than or equal to approximately 15 gallons. The low fluid capacity heating chamber can include a fluid capacity of less than or equal to approximately 10 gallons. The low fluid capacity heating chamber can include a fluid capacity of less than or equal to approximately 5 gallons. The low fluid capacity heating chamber can be configured to have a fluid capacity of less than or equal to approximately 2 gallons.

The fluid heating device can include one or more temperature sensors that can be configured to detect a temperature of the fluid.

The fluid heating device can include a flow sensor that can be configured to detect a flow of the fluid.

The fluid heating device can include a fluid mixing valve, which can be configured to control the temperature of the fluid. The fluid mixing valve can be controlled by the controller that controls the heat pump or by a separate controller.

The fluid heating device can include a supplemental heat source that can be configured to heat the fluid. The supplemental heat source can be controlled by the controller that controls the heat pump. Alternatively, the supplemental heat source can be controlled by a different controller associated with the supplemental heat source.

The fluid heating device can include a ventilation system that is configured to cool the heat pump.

The disclosed technology includes a method of controlling a fluid heating system. The method can include detecting, by a flow sensor, flow data of the fluid as well as detecting, by a temperature sensor, temperature data of the fluid. The method can include the controller outputting instructions to the heat pump in response to determining that the flow data indicates a positive flow of the fluid or that the temperature data indicates the fluid temperature is less than a predetermined temperature setting.

The method can include the controller outputting instructions to the controller to heat the fluid in response to determining that the fluid temperature cannot be maintained at a predetermined temperature setting for a predetermined time based on the flow data and the temperature data.

The method can include the controller outputting adjustment instructions to the fluid mixing valve in response to determining that the fluid temperature is outside of a predetermined temperature range.

The method can also include the controller outputting instructions to a supplemental heat source to heat the fluid in response to determining that the fluid temperature is less than a predetermined temperature setting.

The disclosed technology includes a system comprising a low fluid capacity heating chamber, a controller, and a memory storing instructions that, when executed, cause the controller to perform certain actions. For example, the controller, as directed by the instructions, can receive flow data from a flow sensor and temperature data from a temperature sensor. The flow data can be indicative of a flow of fluid (e.g., water) at a location of the flow sensor, and the temperature data can be indicative of a temperature of the fluid at a location of the temperature sensor. The controller, as directed by the instructions, can output a heat pump control signal in response to determining that (i) the flow data indicates a positive flow rate or (ii) the temperature data indicates a fluid temperature (e.g., water temperature) that is lower than a predetermined temperature setting.

The instructions can cause the controller to output another heat pump control signal in response to determining that the fluid temperature cannot be maintained at a predetermined temperature setting for a predetermined amount of time, based on the flow data indicating a positive flow of the fluid and temperature data indicating the fluid temperature is lower than a predetermined temperature setting.

The instructions can cause the controller to output a fluid mixing valve control signal in response to determining that the temperature data indicates a water temperature that is outside of a predetermined temperature range.

The instructions can cause the controller to output a supplemental heat source control signal in response to determining that the temperature data indicates a water temperature that is lower than a predetermined temperature.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
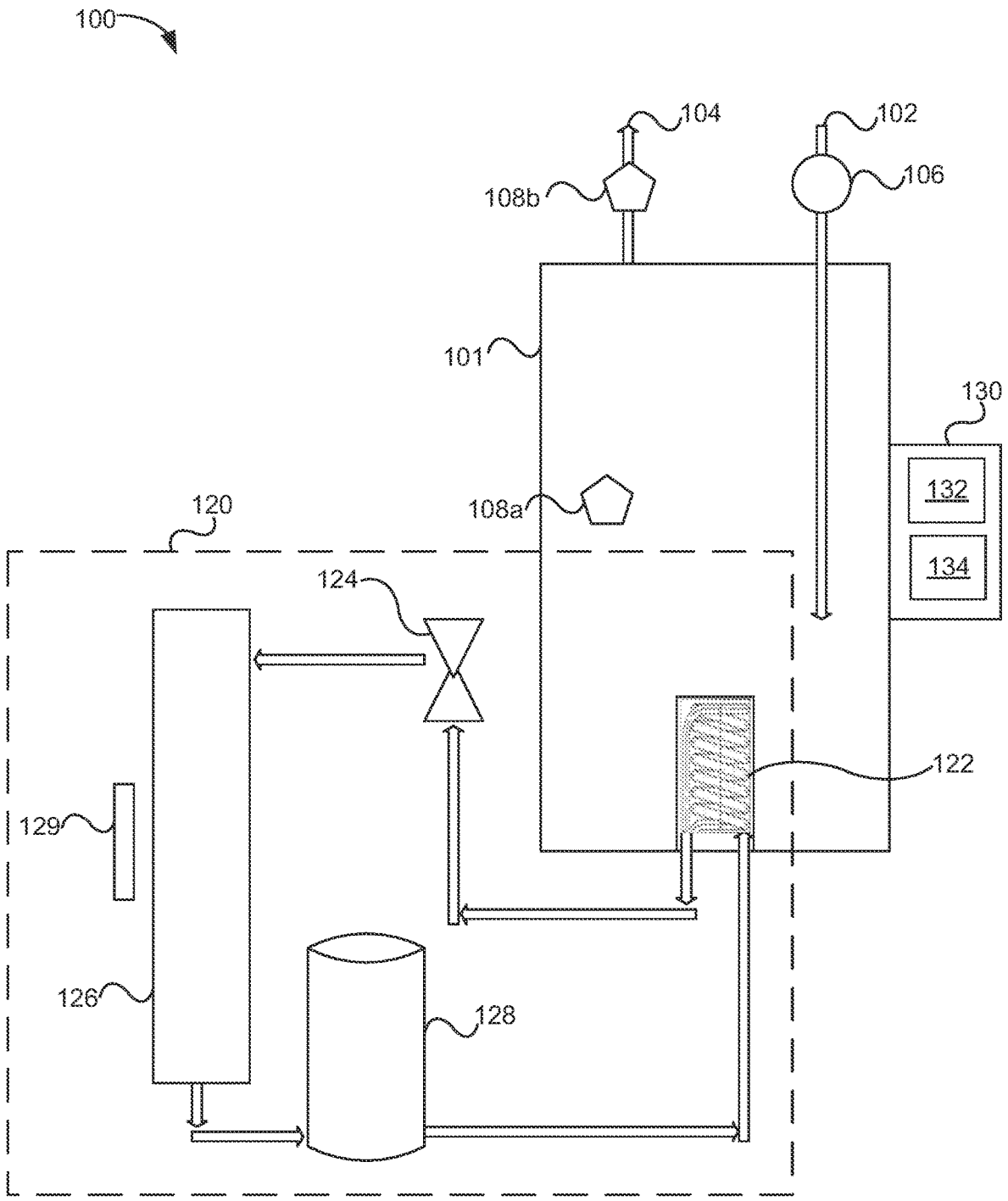
FIG. 1 is a schematic view of an on-demand heat pump water heater, in accordance with the presently disclosed technology.

The disclosed technology relates to an efficient on-demand fluid heater having a heat pump to heat fluid (e.g., water). Existing on-demand water heaters are generally more efficient than traditional large storage tank water heaters because they typically heat the water only when necessary and can thus reduce the amount of heated water kept in a storage tank. Because on-demand water heaters do not require a large capacity storage tank, they can be installed much closer to the point of use, which can further reduce the amount of heat lost while in transit to the user (e.g., while traveling through a network of pipes). The on-demand fluid heaters disclosed herein (which includes on-demand water heaters) can provide improved heating efficiencies as compared to existing systems, which can in turn provide lower operating costs to a user.

Examples of the present disclosure relate to on-demand fluid heaters which utilize a heat pump as the heat source. Examples of the disclosed technology are discussed herein with reference to heating "fluid" or "water." It is to be appreciated that the disclosed technology can be used with a variety of fluids, including water. Thus, while some examples may be described in relation to heating water specifically, all examples of the disclosed technology can be used with fluids other than water unless otherwise specified. Although certain examples of the disclosed technology are explained in detail, it is to be understood that other examples are contemplated. Accordingly, it is not intended that the disclosed technology be limited in its scope to the details of construction and arrangement of components set forth in the following description or illustrated in the drawings. The disclosed technology is capable of other embodiments and of being practiced or carried out in various ways. Also, in describing the many examples, specific terminology will be resorted to for the sake of clarity.

It should also be noted that, as used in the specification and the appended claims, the singular forms "a," "an" and "the" include plural references unless the context clearly dictates otherwise. References to a composition containing "a" constituent is intended to include other constituents in addition to the one named.

Also, in describing the example embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other example embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, for example, similar components that are developed after development of the presently disclosed subject matter.

To facilitate an understanding of the principles and features of the disclosed technology, various illustrative examples are explained below. In particular, the presently disclosed subject matter is described in the context of being an on-demand heat pump water heater. The present disclosure, however, is not so limited, and can be applicable in other contexts. For example and not limitation, the disclosed technology may improve other fluid heating systems, whether considered on-demand or not. Such examples and/or applications are contemplated within the scope of the present disclosure. Accordingly, when the present disclosure is described in the context of a deployment system for an on-demand heat pump water heater, it will be understood that other embodiments can take the place of those referenced.

Referring now to the drawings, in which like numerals represent like elements, example embodiments of the present disclosure are herein described.

FIG. 1 is a schematic view of an example on-demand heat pump water heater 100 that includes a low fluid capacity heating chamber 101, a fluid inlet 102, a fluid outlet 104, a flow sensor 106, a temperature sensor (e.g., one or both of temperature sensors 108*a*, 108*b*), a heat pump 120, and a controller 130. The heat pump 120 comprises a condenser 122, an expansion valve 124, an evaporator 126, and a compressor 128. Optionally, the heat pump can include or be in communication with a ventilation system 129 to cool the heat pump 120. The controller 130 can control the heat pump 120 to maintain the temperature of the fluid at a predetermined temperature setting (e.g., a predetermined value, a predetermined range of values) by analyzing data received from the flow sensor 106 and/or the temperature sensor(s) 108*a*, 108*b*. One of skill in the art will understand that FIG. 1 is an example for illustrative purposes and that the various components of the on-demand heat pump water heater 100 can be arranged in various orders, locations, and configurations.

Although commonly referred to as "tankless" water heaters, on-demand water heaters often use some form of small storage tank in which to heat the water. The low fluid capacity heating chamber 101 can be used as a temporary storage location for the heat pump 120 to add heat to the water. The low fluid capacity heating chamber 101 can be sized for various applications. For example, the low fluid capacity heating chamber 101 can have a capacity of fifteen gallons or less for a typical usage application. As another example, the low fluid capacity heating chamber 101 can be sized between one and two gallons for use with a bathroom sink in a user's home, as based on the average user's demand for hot water. Depending on the application, the low fluid capacity heating chamber 101 can have a capacity of 0.25 gallons, 0.5 gallons, 1 gallon, 1.5 gallons, 2, gallons, 2.5 gallons, 3 gallons, 3.5 gallons, 4 gallons, 4.5 gallons, 5 gallons, or any other appropriate size to fit the particular application. For example, the low fluid capacity heating chamber 101 can have a capacity of ten gallons, fifteen gallons, or more. The low fluid capacity heating chamber 101 can be sized to meet Department of Energy (DOE) conservation standards for consumer water heaters. For example, the low fluid capacity heating chamber can be less than 2 gallons to meet DOE standards for electric instantaneous water heaters found in 10 C.F.R. 430.32(d). The low fluid capacity heating chamber 101 can be made of any suitable material for storing and heating water, including copper, carbon steel, stainless steel, ceramics, polymers, composites, or any other appropriate material. Furthermore, the low fluid capacity heating chamber 101 can be treated or lined with a coating to prevent corrosion and leakage. An appropriate treating or coating will be capable of withstanding the demand temperature of the heated water and pressure of the system and can include, as non-limiting examples, glass enameling, galvanizing, thermosetting resin-bonded lining materials, thermoplastic coating materials, cement coating, or any other appropriate treating or coating for the application. Optionally, the low fluid capacity heating chamber 101 can be insulated to retain heat. For example, the low fluid capacity heating chamber 101 can also be insulated using fiberglass, aluminum foil, organic material, or any other appropriate insulation material.

As shown in FIG. 1, the disclosed technology can include a heat pump 120 to heat water. The heat pump 120 can be any suitable form of heat pump that can be used to heat water, including compression- or absorption-type heat pumps. The heat pump 120 can be adapted to use an air source, ground source, water source, or any other heat source. The heat pump 120 can also be a geothermal, air-to-water, water-to-water, liquid-to-water, or any other type of heat pump system that is appropriate for the particular application. As an example, the heat pump 120 can be an air source type heat pump, which utilizes a refrigerant in a vapor-compression cycle, but the type of heat source can be modified depending on the particular application. Furthermore, the heat pump 130 can be a single-stage, two-stage, or variable capacity heat pump, depending on the application.

The heat pump 120 can include a condenser 122, an expansion valve 124, an evaporator 126, and a compressor 128. The various components can be sized, shaped, and located as is appropriate for the particular application. For example, the compressor 128 can be powered by any appropriate energy source, including electrical power, a combustion engine, or any other energy source capable of operating the compressor 128. The compressor 128 can be any type of compressor. For example, the compressor 128 can be a positive displacement compressor, a reciprocating compressor, a rotary screw compressor, a rotary vane compressor, a rolling piston compressor, a scroll compressor, a diaphragm compressor, a dynamic compressor, an axial compressor, or any other form of compressor that can be integrated into a heat pump. The condenser 122 can be installed in a position that improves energy transfer to the water in the low fluid capacity heating chamber 122. On the other hand, the evaporator 126 can be located where it can absorb heat from its surroundings. As discussed above, this can include any heat source, such as air, water, or geothermal sources. Both the condenser 122 and the evaporator 126 can be made of material(s) that can effectively exchange heat, including copper, aluminum, stainless steel, gold, silver, gallium, indium, thallium, graphite, composite materials, or any other material that is appropriate for a given application. A given application can have specific system requirements, such as, as non-limiting examples, the desired water temperature, heat transfer rate (e.g., Btu/hr required to heat the source water), environmental conditions (e.g., the climate in which the system is installed), and cost considerations. Furthermore, the expansion valve can be any type of expansion valve. For example, the expansion valve 124 can be a thermal expansion valve, a manual expansion valve, an automatic expansion valve, an electronic expansion valve, a low-pressure float valve, a high-pressure float valve, capillary tubes, or any other form of expansion valve appropriate for the application. The size, type, and installed location of the expansion valve 124 can vary depending on the application, which can be influenced by the above system requirements or other considerations.

The on-demand heat pump water heater 100 can include various sensing devices that collect data about the water in the system. FIG. 1 shows a flow sensor 106 and temperature sensors 108*a*, 108*b*. The flow sensor 106 is shown as being installed just downstream of the fluid inlet 102 but can be installed in alternative locations that are in fluid communication with the low fluid capacity heating chamber 101. For example, the flow sensor 106 can be installed just downstream of the fluid inlet, inside the low fluid capacity heating chamber 101, downstream of the low fluid capacity heating chamber 101, or even upstream of the fluid inlet 102 or downstream of the fluid outlet 104 so long as the flow sensor 106 is able to detect a positive flow (fluid flowing through the low fluid capacity heating chamber 101 in the direction from the fluid inlet 102 and toward the fluid outlet 104) of a fluid flowing into the low fluid capacity heating chamber 101. Regardless of position, the flow sensor 106 can detect the flow rate of the fluid at the location of the flow sensor and can transmit flow data indicative of the flow rate to the controller 130. The flow sensor 106 can be any type of flow sensor and can be configured to simply detect fluid flow or can be used to detect rate of flow of the fluid. If it is desirable to simply measure the presence of fluid flow, the flow sensor 106 can be a flow switch. If the flow sensor 106 is a flow switch, it can be a vane actuated flow switch, a disc actuated flow switch, a liquid flow switch, or any other appropriate type of flow switch for the application. If it is desirable to measure the rate of fluid flow, the flow sensor 106 can be a flow meter or another type of rate-measuring flow sensor. For example, the flow sensor 106 can be a differential pressure flow meter, a positive displacement flow meter, a velocity flow meter, a mass flow meter, an open channel flow meter, or any other type of flow meter configured to measure flow rate of a fluid. The type of flow sensor 106 used will depend on the type of fluid being measured, its temperature and pressure, viscosity, conductivity, corrosiveness, and cleanliness required of the system.

Figure 2:
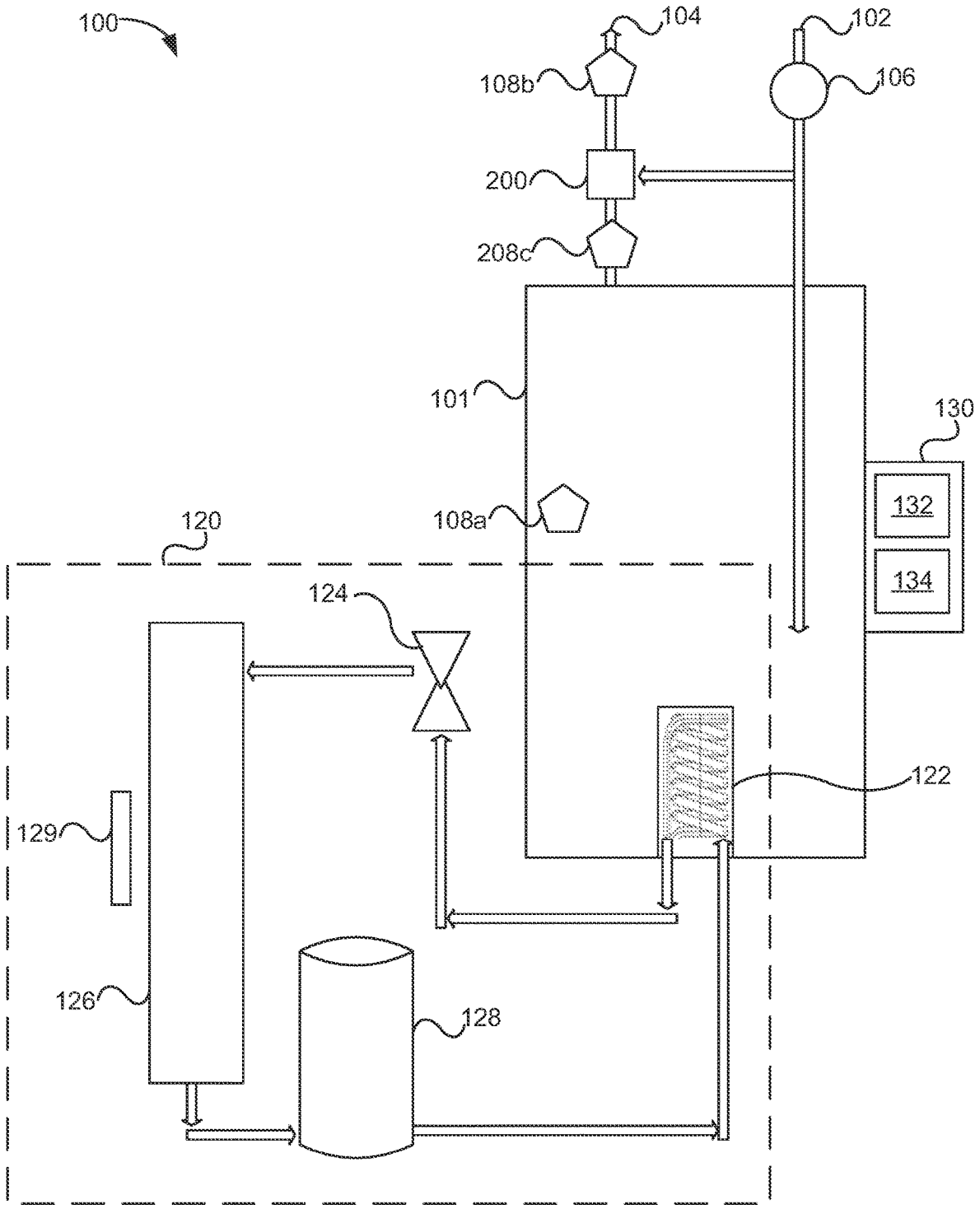
FIG. 2 is a schematic view of an on-demand heat pump water heater with a mixing valve, in accordance with the presently disclosed technology.
Figure 3:
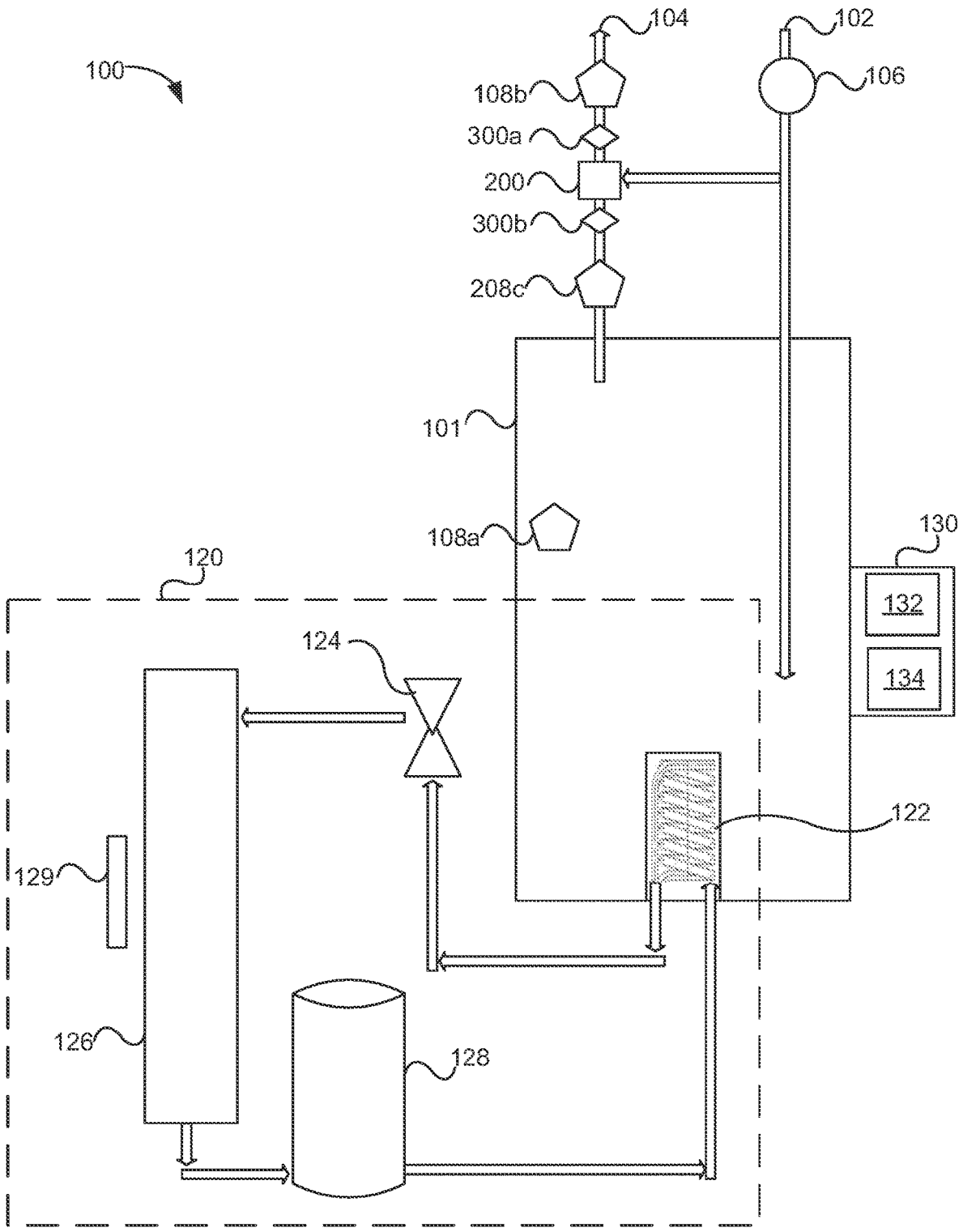
FIG. 3 is a schematic view of an on-demand heat pump water heater with a mixing valve and a supplemental heat source, in accordance with the presently disclosed technology.

Similar to the flow sensor 106, the temperature sensor(s) 108*a*, 108*b* can be installed in any appropriate location that allows the temperature sensor(s) 108*a*, 108*b* to detect temperature data of fluid at the installed location of the temperature sensor(s) 108*a*, 108*b*. Although two temperature sensors 108*a* and 108*b* are shown in FIG. 1, the on-demand heat pump water heater 100 can include only a single temperature sensor. For example, the on-demand heat pump water heater 100 can include only temperature sensor 108*a* to measure the temperature of the fluid within the low fluid capacity heating chamber 101, or the on-demand heat pump water heater 100 can include only temperature sensor 108*b* to measure the temperature of the fluid exiting the low fluid capacity heating chamber 101. Alternatively, the on-demand heat pump water heater 100 can include two temperature sensors as depicted in FIG. 1, or can include three, four, five, or more temperature sensors (e.g., as depicted in FIGS. 2 and 3 and as discussed more fully below).

Referring to the dual temperature sensor example shown in FIG. 1, one temperature sensor 108*a* can be installed in the low fluid capacity heating chamber 101 to detect a temperature of the fluid inside the low fluid capacity heating chamber 101, which can be representative of an average temperature of the fluid within the low fluid capacity heating chamber 101. The temperature of the fluid within the low fluid capacity heating chamber 101 will typically be highest near the heat pump 120 and lowest near the fluid inlet 102. Therefore, the temperature sensor 108*a* can be positioned in a location that best represents the average temperature of the fluid, which can be useful to ensure the water is being heated to the proper temperature while water is or is not flowing through the water heater 100. Another temperature sensor 108*b* can be installed downstream of the low fluid capacity heating chamber 101 (e.g., at fluid outlet 104) and can be configured to monitor the temperature of the water exiting the low fluid capacity heating chamber 101, which can be useful to ensure the water is being heated to the proper temperature while water is being drawn through the system.

The temperature sensor(s) 108*a*, 108*b* can be any type of sensor capable of measuring temperature of a fluid and providing temperature data indicative of the fluid temperature to the controller 130. For example, the temperature sensor(s) 108*a*, 108*b* can be thermocouples, resistor temperature detectors, thermistors, infrared sensors, semiconductors, or any other type of sensors which would be appropriate for a given use or application. All temperature sensors of the system can be the same type of temperature sensor, or the system can include different types of temperature sensors. For example, temperature sensor 108*a* can be a thermocouple and temperature sensor 108*b* can be a thermistor. One skilled in the art will appreciate that the type, location, and number of temperature sensors can vary depending on the application.

The heat pump 120 can be controlled by a controller 130. The controller 130 can be a computing device configured to receive data, determine actions based on the received data, and output a control signal instructing one or more components of the system to perform one or more actions. Although shown in FIG. 1 as being mounted to the low fluid capacity heating chamber 101, one of skill in the art will understand that the controller 130 can be installed in any location, provided the controller 130 is in communication with at least some of the components of the system. This can include installation in or on an enclosure including one or more of the other components depicted in FIG. 1 or installation at a remote location physically separated from the components shown in FIG. 1. Furthermore, the controller 130 can be configured to send and receive wireless or wired signals; the controller 130 can be configured to send and receive analog or digital signals. The wireless signals can include Bluetooth™, BLE, WiFi™, ZigBee™, infrared, microwave radio, or any other type of wireless communication as may be appropriate for the particular application. The hard-wired signal can include any directly wired connection between the controller and the other components. For example, the controller 130 can have a hard-wired 120-volt connection to the heat pump 120 which directly energizes the heat pump. Alternatively, the components can be powered directly and receive control instructions from the controller 130 via a digital connection. The digital connection can include a connection such as an Ethernet or a serial connection and can utilize any appropriate communication protocol for the application such as Modbus, fieldbus, PROFIBUS, SafetyBus p, Ethernet/IP, or any other appropriate communication protocol for the application. Furthermore, the controller 130 can utilize a combination of wireless, hard-wired, and digital communication signals to communicate with and control the various components. One of skill in the art will appreciate that the above configurations are given merely as non-limiting examples and the actual configuration may vary depending on the application.

The controller 130, can include memory 132, which can store a program and/or instructions associated with the functions described herein, and can include a processor 134 configured to execute the program and/or instructions. The memory 132 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques described herein can be implemented as a combination of executable instructions and data within the memory.

The processor 134 can be one or more known processing devices, such as a microprocessor from the Pentium™ family manufactured by Intel™, the Turion™ family manufactured by AMD™, or the Cortex™ family or SecurCore™ manufactured by ARM™. The processor can constitute a single-core or multiple-core processor that executes parallel processes simultaneously. For example, the processor 134 can be a single core processor that is configured with virtual processing technologies. One of ordinary skill in the art would understand that other types of processor arrangements could be implemented that provide for the capabilities disclosed herein.

As depicted in FIG. 1, the controller 130 can be configured to receive data from the flow sensor 106 and one or more temperature sensors 108*a*, 108*b*. The controller 130 can be configured to engage the heat pump 120 and other components only when necessary, which can reduce the amount of power required to operate the system over a given period of time (e.g., a year). For example, the controller 130 can receive flow data from the flow sensor 106, determine whether the flow data indicates a positive flow rate, and activate the heat pump 120 if the fluid in the system has begun to flow. Alternatively or in addition, the controller 130 can receive temperature data from a temperature sensor 108*a*, 108*b*, determine whether the temperature data indicates a temperature that is less than a predetermined temperature setting, and activate the heat pump 120 if the detected temperature is less than the predetermined temperature setting (a "low temperature"). The controller 130 can determine the detected temperature is a low temperature based on one, some, or all of the temperature sensors 108*a*, 108*b* of the on-demand heat pump water heater 100, which can correspond to the detected water temperatures at multiple positions throughout the on-demand heat pump water heater 100. For example, the controller 130 can be configured to engage the heat pump 120 if any single temperature sensor 108*a*, 108*b* detects a low temperature. As another example, the controller 130 can be configured to engage the heat pump 120 only if all temperature sensors 108*a*, 108*b* detect a low temperature. As yet another example, the controller 130 can be configured to engage the heat pump 120 if a predetermined number (e.g., a majority) of temperature sensors 108*a*, 108*b* detect a low temperature. As yet another example, the controller 130 can be configured to engage the heat pump if a predetermined combination of temperature sensors 108*a*, 108*b* detect a low temperature. That is, the controller 130 can be configured to weigh data from a given temperature sensor more heavily than data from another temperature sensor, based on the location, type, accuracy, or other aspect of the temperature sensors.

The controller 130 can be configured to receive temperature data from a temperature sensor 108*a*, 108*b* and flow data from a flow sensor 106 and can determine whether the fluid can be maintained at the predetermined temperature for a predetermined amount of time based on the current temperature, flow rate, and/or output of the heat pump 120. This can enable the controller 130 to, for example, adjust the performance of the heat pump 120 to improve the efficiency of the system and/or prevent damage to the heat pump 120 or other components. Thus, if the heat pump 120 is a two-stage or variable capacity heat pump, the controller 130 can adjust the control signal to the heat pump 120 to vary its performance and the amount of heat transferred to the fluid. For example, if the controller 130 received flow data from the flow sensor 106 that indicated the fluid was flowing at a rate of 1.5 gallons per minute and received data from a temperature sensor 108*b* indicating that the current temperature of the fluid downstream of the low fluid capacity heating chamber 101 was 120° F., the controller 130 could determine whether the fluid could be maintained at a predetermined temperature setting for a predetermined amount of time (e.g., 1 minute, 2 minutes, 3 minutes, 5 minutes) based on the flow rate data (e.g., 1.5 gal/min), the temperature data (e.g., 120° F.), and/or known performance capabilities of the heat pump 120. If the controller 130 determines that the current heat pump 120 output would be inadequate to maintain the water temperature at the predetermined temperature setting, the controller 130 can transmit a control signal to the heat pump 120 indicating that the heat pump 120 should operate at a higher output (or a control signal instructing the heat pump 120 to disengage if the controller 120 determines that operation at a higher output would damage the heat pump 120 or other components of the on-demand heat pump water heater 100).

The controller 130 can be configured to monitor temperature data from a temperature sensor 108*a* to ensure the temperature of the fluid inside the low fluid capacity heating chamber 101 is maintained at a predetermined temperature setting even when no fluid is flowing. Accordingly, the controller 130 can be configured to ensure the water inside the low fluid capacity heating chamber 101 is heated and ready for use. By pre-heating water, the system can provide the user with a source of immediately available heated water, which can provide additional time for the on-demand heat pump water heater 100 to heat incoming water for further use.

As briefly discussed above, the controller 130 can be configured to determine actions based on data received from the flow sensor 106 and/or the temperature sensor(s) 108*a*, 108*b*. The controller 130 can be configured to maintain the temperature of fluid in the low fluid capacity heating chamber within a predetermined temperature range. For example, the predetermined temperature range can be from approximately 105° F. to approximately 135° F. When the temperature of the fluid falls below the lower endpoint of the predetermined temperature range (e.g., approximately 105°

F.), the controller 130 can be configured to send a control signal to the heat pump 120 to energize the heat pump 120 and raise the temperature of the fluid. The control 130 can instruct the heat pump 120 to raise the temperature of the fluid until a predetermined fluid temperature is reached, such as a midpoint value between the endpoints of the predetermined temperature range (e.g., approximately 120° F. in the immediate example). Similarly, when the temperature of the fluid rises above the upper endpoint of the predetermined temperature range (e.g., approximately 135° F.), the controller 130 can send a control signal to the heat pump 120 to de-energize the heat pump and cease adding heat to the fluid. The controller 130 can instruct the heat pump 120 to cease adding heat to the fluid until a predetermined fluid temperature is reached, such as a midpoint value between the endpoints of the predetermined temperature range (e.g., approximately 120° F.).

As another example, the controller 130 can be configured to maintain the fluid in the low fluid capacity heating chamber within a smaller temperature range to ensure the water is closer to a desired temperature value when demanded. For example, the predetermined temperature range can be from approximately 123° F. to approximately 127° F., and the predetermined temperature range can correspond to a target temperature value of approximately 125° F. When the temperature of the fluid falls below 123° F., the controller 130 can send a control signal to the heat pump 120 to energize the heat pump 120 and raise the temperature of the fluid. Similarly, when the temperature of the fluid rises above 127° F., the controller 130 can send a control signal to the heat pump 120 to de-energize the heat pump and cease adding heat to the fluid. The given example temperature ranges are merely for illustration and can vary depending on the given application.

Furthermore, the controller 130 can be configured to determine and instruct multiple actions on the received temperature data and the received flow data. For example, the controller 130 can be configured to maintain the fluid within the low fluid capacity heating chamber 101 between 115° F. to 126° F. when water is not flowing and between 124° F. to 130° F. when the water is flowing. One of skill in the art will understand that these temperature ranges and instructions provided by the controller 130 are offered merely as example and that the actual configuration can be varied depending on the application.

FIG. 1 also depicts an optional ventilation system 129, which can be used to cool certain components of the heat pump 120. The ventilation system 129 can be installed directly on the on-demand heat pump water heater 100 or it can be installed nearby to facilitate cooling. For example, the ventilation system 129 can be installed on a door or wall of a housing in or on which the on-demand heat pump water heater 100 is installed (e.g., on the wall or door of the cupboard below a sink where the on-demand heat pump water heater 100 is installed). The ventilation system 129 can be configured to operate continuously, while the heat pump 120 is operating, once the fluid temperature has reached a predetermined temperature setting, or any combination thereof. The ventilation system 129 can be controlled by the controller 130 or can be controlled by a dedicated control system separate from the controller 130. If the ventilation system 129 has its own controller, the ventilation system's 129 controller can be in communication with the controller 130 (e.g., to receive temperature data or an indication that the heat pump 120 is engaged). Furthermore, the ventilation system 129 can be an active ventilation system, such as a mechanical fan, or a passive venting system, such as a vent or louver.

FIG. 2 is a schematic view of an example on-demand heat pump water heater 100 including a mixing valve 200 and an additional temperature sensor 208*c*. The mixing valve 200 and temperature sensor 208*c* can be useful to provide more precise temperature control of the fluid delivered at the point of use as compared to, for example, the example depicted by FIG. 1; however, the additional components may also raise the overall cost and complexity of the system.

The mixing valve 200 can be any type of mixing valve. For example, the mixing valve 200 can be a thermostatic mixing valve, a tempering valve, a pressure balanced valve, an electronically-controlled mixing valve, or any other type of mixing valve as would be appropriate for the application. The mixing valve 200 can be passive or active in controlling the water output temperature. For example, the mixing valve 200 can be manually controlled and intended to be set at the proper setting upon installation and adjusted as required or desired by the user. Alternatively, the mixing valve 200 can be an electronically-controlled mixing valve that is configured to receive an input signal from the controller 130 and adjust its position or configuration (e.g., how "open" the valve is) to achieve the desired water temperature. The appropriate type of mixing valve can depend on the particular application, environmental factors, and other aspects of the on-demand heat pump water heater 100.

The mixing valve 200 can be a thermostatic mixing valve, which can be set to ensure the temperature of water exiting the fluid outlet 104 of the on-demand heat pump water heater 100 is within a predetermined temperature range. The thermostatic mixing valve can adjust the position or configuration of the mixing valve depending on the temperature of the water exiting the fluid outlet 104 and would do so without any input from the controller. As another example, the mixing valve 200 can be an electronically controlled mixing valve and be configured to adjust its position depending on control signals received from the controller 130. For example, the controller 130 can send a control signal to the mixing valve 200 to adjust its position or configuration to ensure water exiting the fluid outlet 104 of the on-demand heat pump water heater 100 is within a predetermined temperature range. One of skill in the art will understand that the exact type and configuration of mixing valve 200 can be varied to achieve the desired result depending on the application and that the above examples are given merely for illustrative purposes. Furthermore, it is contemplated that the mixing valve 200 (e.g., an electronically controlled mixing valve) can be controlled by the controller 130 or by a separate controller (e.g., a controller dedicated to control of the mixing valve 200) If the mixing valve 200 has a dedicated controller, the dedicated mixing valve controller can be in communication with the controller 130 or other components of the on-demand heat pump water heater 100.

The temperature sensor 208*c* can be any type or configuration of temperature sensor as discussed above with respect to temperature sensors 108*a*, 108*b*. The inclusion of temperature sensor 208*c* can provide an additional temperature measurement of the temperature of the fluid exiting the low fluid capacity heating chamber 101 and entering the mixing valve 200. As an example, the temperature sensor 208*c* can be used in conjunction with a mixing valve 200 which is electronically controlled. In this example, the controller 130 can receive temperature data from the temperature sensor 208*c*, which is indicative of the temperature of the fluid exiting the low fluid capacity heating chamber 101 and entering the mixing valve 200. The controller 130 can determine the proper position of the mixing valve 200 based on the received temperature data and can send a control signal to the mixing valve 200 to adjust the position of the mixing valve 200, ensuring the temperature of the fluid exiting the fluid outlet 104 is within a predetermined temperature range. The controller 130 can also make this determination by considering flow data received from the flow sensor 106 and/or temperature data received from any of the temperature sensors 108*a*, 108*b*, and 208*c*. One of skill in the art will understand that the actual configuration of the components depicted in FIG. 2 can be arranged in different configurations and achieve similar results.

FIG. 3 is a schematic view of an on-demand heat pump water heater 100 including supplemental heat sources (e.g., supplemental heat source 300*a* and 300*b*), which can be used to supply additional heat to the fluid. The supplemental heat sources 300*a* and/or 300*b* can provide increased precision of temperature control as compared to other examples; however, the inclusion of a supplemental heat source can also increase the complexity and overall cost of the system. Although FIG. 3 shows two supplemental heat sources 300*a* and 300*b*, it is contemplated that supplemental heat can be added to the fluid by use of only one supplemental heat source or multiple supplemental heat sources depending on the particular application. The supplemental heat sources 300*a* and/or 300*b* can be any form of supplemental heat source as would be appropriate for the particular application. For example, the supplemental heat sources 300*a* and/or 300*b* can be electrical resistive heating elements, propane burners, natural gas burners, solar thermal heating, or any other appropriate type of supplemental heat source for the application. The supplemental heat sources 300*a* and 300*b*, if both are installed in the system together, can be the same type of heat source or can be different types of heat sources. For example, supplemental heat source 300*a* can be a natural gas burner while supplemental heat source 300*b* can be an electrical resistive heating element.

In an example system, a supplemental heat source 300*a* can be positioned and configured to heat the fluid exiting the mixing valve 200. For example, in response to determining that the temperature of the fluid exiting the mixing valve is less than the predetermined temperature setting, the controller 130 can output instructions to the supplemental heat source 300*a* to transfer heat to the fluid. As another example, the controller 130 can output instructions to the supplemental heat source 300*b* to transfer heat to the fluid exiting the heating chamber 101 and entering the mixing valve 200 in response to determining that the fluid exiting the heating chamber 101 is at a low temperature. As yet another example, the controller 130 can determine that the fluid temperature will fall below a predetermined temperature setting based on the current flow rate, current fluid temperature, and/or heat pump 120 capabilities, and in response to so determining, the controller 130 can output instructions to one or more supplemental heat source(s) 300*a*, 300*b* to transfer heat to the fluid. The predetermined temperature setting that is used to determine whether to engage or utilize the supplemental heat source(s) 300*a*, 300*b* can be the same or a different predetermined temperature setting that is used to determine whether to utilize the heat pump 120. The supplemental heat source(s) 300*a*, 300*b* can be used in an on-demand heat pump water heater 100 whether or not the water heater 100 includes a mixing valve 200.

Furthermore, it is contemplated that the supplemental heat source(s) 300*a*, 300*b* can be controlled by the controller 130 or by a separate controller (e.g., a controller dedicated to control of one or more supplemental heat source(s) 300*a*, 300*b*). If the supplemental heat source(s) 300*a*, 300*b* have a dedicated controller, the dedicated supplemental heat source controller can be in communication with the controller 130 or other components of the on-demand heat pump water heater 100.

Figure 4:
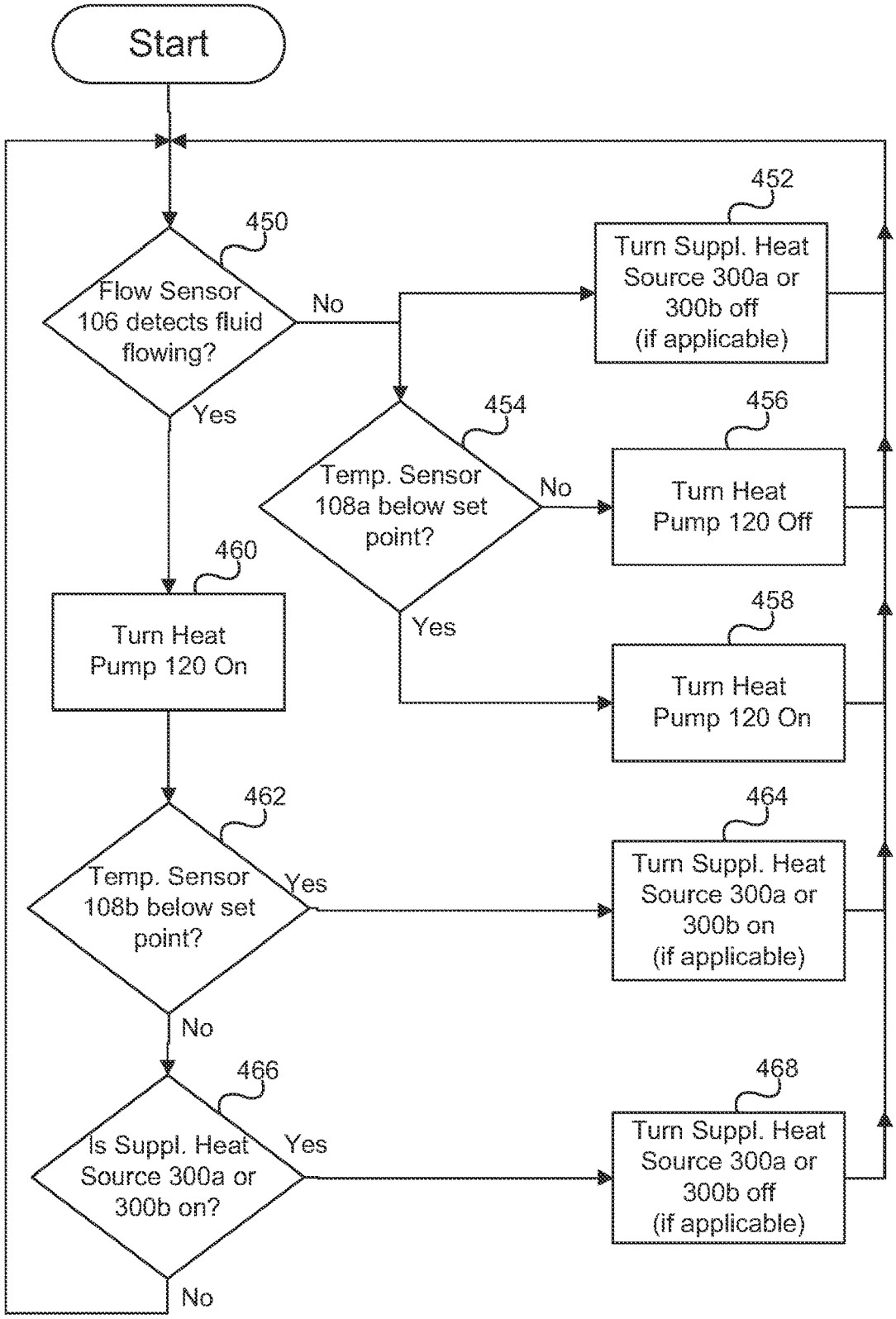
FIG. 4 is a logic diagram of an on-demand heat pump water heater system, in accordance with the presently disclosed technology.

FIG. 4 is a logic diagram of an example on-demand heat pump water heater 100 system. FIG. 4 is not meant to limit the many different configurations in which the controller 130 can function but is given merely as an example for illustrative purposes. Furthermore, one of skill in the art will understand that the logic depicted in FIG. 4 can be altered as necessary to encompass the many different configurations of the on-demand heat pump water heater 100 as previously discussed or other configurations not discussed.

In an example, as shown in FIG. 4, the controller 130 can perform a sequence of logic checks to operate the heat pump 120 and regulate the temperature of the fluid based on a predetermined temperature setting. In this example, the controller 130 can receive flow data from a flow sensor (e.g., flow sensor 106) and determine 450 if the flow data indicates that fluid is flowing into the low fluid capacity heating chamber 101. If the flow data indicates that fluid is not currently flowing, the controller 130 can send a control signal to the supplemental heat source (e.g., supplemental heat source 300*a* and/or 300*b*) to disengage 452. The controller 130 can then receive temperature data from a temperature sensor (e.g., temperature sensor 108*a*, 108*b*, or 208*c*) and determine 454 if the temperature of the fluid in the low fluid capacity heating chamber 101 is below a predetermined temperature setting. If the temperature of the fluid in the low fluid capacity heating chamber 101 is below the predetermined temperature setting, the controller 130 can send a control signal to the heat pump 120 to engage 458 and begin heating the fluid. If the temperature of the fluid in the low fluid capacity heating chamber 101 is above the predetermined temperature setting, the controller 130 can send a control signal to the heat pump 120 to disengage 456 and cease heating the fluid.

If the controller 130 determines 450 that the fluid is currently flowing, the controller 130 can send a control signal to the heat pump 120 to engage 460 and begin heating the fluid in the low fluid capacity heating chamber 101. The controller 130 can then receive temperature data from a temperature sensor (e.g., temperature sensor 108*a*, 108*b*, or 208*c*) installed near the fluid outlet 104 and determine 462 whether the fluid being delivered to the user is at a temperature that satisfies a predetermined temperature setting. If the temperature of the fluid near the fluid outlet 104 is below the predetermined temperature setting, the controller 130 can then send a control signal to a supplemental heat source (e.g., 300*a* and/or 300*b*) to engage 464 and begin adding supplementary heat to the fluid. On the other hand, if the temperature of the fluid near the fluid outlet 104 is above the predetermined temperature setting, the controller 130 can determine 466 whether the supplemental heat source (e.g., supplemental heat source 300*a* and/or 300*b*) is currently providing supplementary heat to the fluid. If the supplemental heat source (e.g. 300*a* and/or 300*b*) is currently providing supplementary heat to the fluid, the controller 130 can then send a control signal to the supplemental heat source (e.g. supplemental heat source 300*a* and/or 300*b*) to disengage 468 and cease providing supplementary heat to the fluid. If the supplemental heat source (e.g. supplemental heat source 300*a* and/or 300*b*) is not currently providing supplementary heat to the fluid, the controller 130 will take no action and begin the sequence over again by determining 450 whether flow sensor 106 detect fluid flow. This is merely one example of a method of controlling the on-demand heat pump water heater 100, and one of skill in the art will understand that the controller 130 can be configured to control alternate configurations of the on-demand heat pump water heater 100 and the controller 130 can accordingly have multiple configurations functionalities as described herein. Furthermore, although this immediate example does not discuss use of a mixing valve 200, one of skill in the art will understand that a mixing valve can be integrated into this and other examples.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. But other equivalent methods or composition to these described aspects are also contemplated by the teachings herein. Therefore, the present disclosure should not be limited to any single aspect, but rather construed in breadth and scope in accordance with the appended claims.

That which is claimed is:

1. A system for heating a fluid, the system comprising:

a heating chamber having a fluid inlet and a fluid outlet, wherein the heating chamber is configured to hold a fluid;

a temperature sensor configured to detect a temperature of the fluid;

a heat pump configured to heat the fluid;

a fluid mixing valve;

a supplemental heat source provided at the fluid inlet or the fluid outlet and configured to heat the fluid; and a controller configured to:

control operation of the heat pump to control the temperature of the fluid based on a predetermined temperature setting;

determine that the temperature of the fluid is below the predetermined temperature setting during operation of the heat pump; and enable, based on determining that the temperature of the fluid is below the predetermined temperature setting during operation of the heat pump, the supplemental heat source to supplement the heat pump to heat the fluid to at least the predetermined temperature, wherein the heat pump comprises a condenser positioned to facilitate energy transfer to the fluid within the heating chamber.

2. The system of claim 1, further comprising a flow sensor configured to detect a flow of fluid downstream of the fluid inlet.

3. The system of claim 1, wherein the fluid mixing valve is controlled by the controller.

4. The system of claim 1, wherein the controller is a first controller, the system further comprising a second controller configured to control the fluid mixing valve.

5. The system of claim 1, wherein the supplemental heat source comprises an electrical resistive heating element.

6. The system of claim 1, wherein the controller is a first controller, the system further comprising a second controller configured to control the supplemental heat source.

7. The system of claim 1, further comprising a ventilation system configured to cool the heat pump.

8. The system of claim 1, wherein the temperature sensor comprises a thermocouple or a thermistor.

9. A method of controlling a fluid heating system, the method comprising:

detecting, by a flow sensor, a flow data of a fluid;

detecting, by a temperature sensor, first temperature data of the fluid;

in response to determining that the flow data indicates positive flow of the fluid, outputting, by a controller and to a heat pump, instructions to heat the fluid in a heating chamber, and the heat pump comprises a condenser positioned to facilitate energy transfer to the fluid within the heating chamber; and in response to determining that the first temperature data indicates fluid temperature is less than a predetermined temperature setting, outputting, by the controller and to the heat pump, instructions to heat the fluid in the heating chamber;

detecting, by a temperature sensor, second temperature data of the fluid; and in response to determining the second temperature data indicates the fluid temperature is less than the predetermined temperature setting, outputting, by the controller and to a supplemental heat source, instructions to heat the fluid in the heating chamber with the supplemental heat source along with the heat pump, wherein the supplemental heat source is provided at a fluid inlet or a fluid outlet of the heating chamber and is configured to heat the fluid.

10. The method of claim 9, further comprising:

in response to determining that the fluid temperature cannot be maintained at a predetermined temperature setting for a predetermined amount of time based on the flow data and the first temperature data, outputting, by the controller and to the heat pump, instructions to heat the fluid in the heating chamber.

11. The method of claim 9, further comprising:

in response to determining that a fluid temperature is outside of a predetermined temperature range, output, by the controller, adjustment instructions to a fluid mixing valve.

12. A system comprising:

a heating chamber;

a heat pump which comprises a condenser positioned to facilitate energy transfer to fluid within the heating chamber;

a mixing valve;

a supplemental heating source provided at a fluid inlet or a fluid outlet of the heating chamber;

a controller; and a memory having instructions stored thereon that, when executed by the controller, directs the controller to:

receive, at a controller and from a flow sensor, flow data indicative of a detected flow rate associated with a fluid;

receive, at the controller and from a temperature sensor, first temperature data indicative of a detected temperature of the fluid; and output a heat pump control signal by the controller in response to determining that (i) the flow data indicates a positive flow of the fluid or (ii) the first temperature data indicates a fluid temperature that is less than a predetermined temperature setting;

receive, from the temperature sensor, second temperature data; and output a supplemental heat source control signal in response to determining that the second temperature data indicates the fluid temperature that is still less than the predetermined temperature setting.

13. The system of claim 12, wherein the heat pump control signal is a first heat pump control signal, and wherein the instructions, when executed by the controller, further direct the controller to:

output a second heat pump control signal by the controller in response to determining, based on the flow data and the first temperature data, that a detected fluid temperature cannot be maintained by the system for a predetermined amount of time.

14. The system of claim 12, wherein the instructions, when executed by the controller, further direct the controller to:

output a fluid mixing valve control signal by the controller in response to determining that the first temperature data indicates a detected fluid temperature that is outside of a predetermined temperature range.

15. The system of claim 12, wherein the heating chamber has a fluid capacity from 0.25 gallons to 15 gallons.

16. The system of claim 1, wherein the supplemental heat source is provided between the mixing valve and the heating chamber.

* * * * *